United States Patent [19]

Holley

[11] 4,122,946

[45] Oct. 31, 1978

[54] INTERFITTING SHIPPING PAD

[75] Inventor: Ronnie E. Holley, Garland, Tex.

[73] Assignee: Lane Container Company, Dallas, Tex.

[21] Appl. No.: 798,159

[22] Filed: May 18, 1977

[51] Int. Cl.[2] ..... B65D 81/10

[52] U.S. Cl. ..... 206/523; 206/588; 206/592

[58] Field of Search ..... 206/454, 521, 523, 583, 206/586, 588, 591–592; 229/14 C, DIG. 1

[56] References Cited

U.S. PATENT DOCUMENTS

| | | | |
|---|---|---|---|
| 2,803,372 | 8/1957 | Lee | 206/588 X |
| 3,292,778 | 12/1966 | Enderle | 206/523 |
| 3,356,209 | 12/1967 | Pezely, Jr. | 206/586 X |
| 3,565,243 | 2/1971 | Freeman | 206/523 |
| 3,912,076 | 10/1975 | Elwell | 206/523 X |
| 3,938,661 | 2/1976 | Carmody | 206/523 |
| 4,015,716 | 4/1977 | Nichols | 229/14 C X |

*Primary Examiner*—Steven E. Lipman

*Attorney, Agent, or Firm*—Richards, Harris & Medlock

[57] ABSTRACT

A shipping pad is provided which has three dimensional shock resistant characteristics. The component parts of the shipping pad may be fabricated from a single sheet of plastic foam material, thus facilitating storage of the unit prior to assembly. After the component parts are removed from the sheet of foam material, they may be assembled into a shipping pad configuration with interlocking cross bars. No adhesive or other fastening means foreign to the foam material need be used.

3 Claims, 4 Drawing Figures

FIG. 1
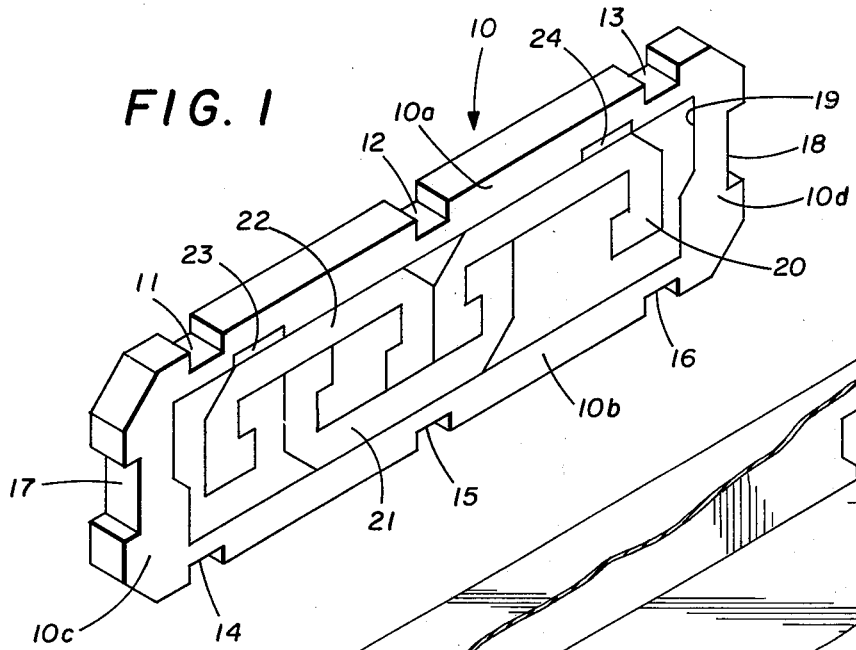
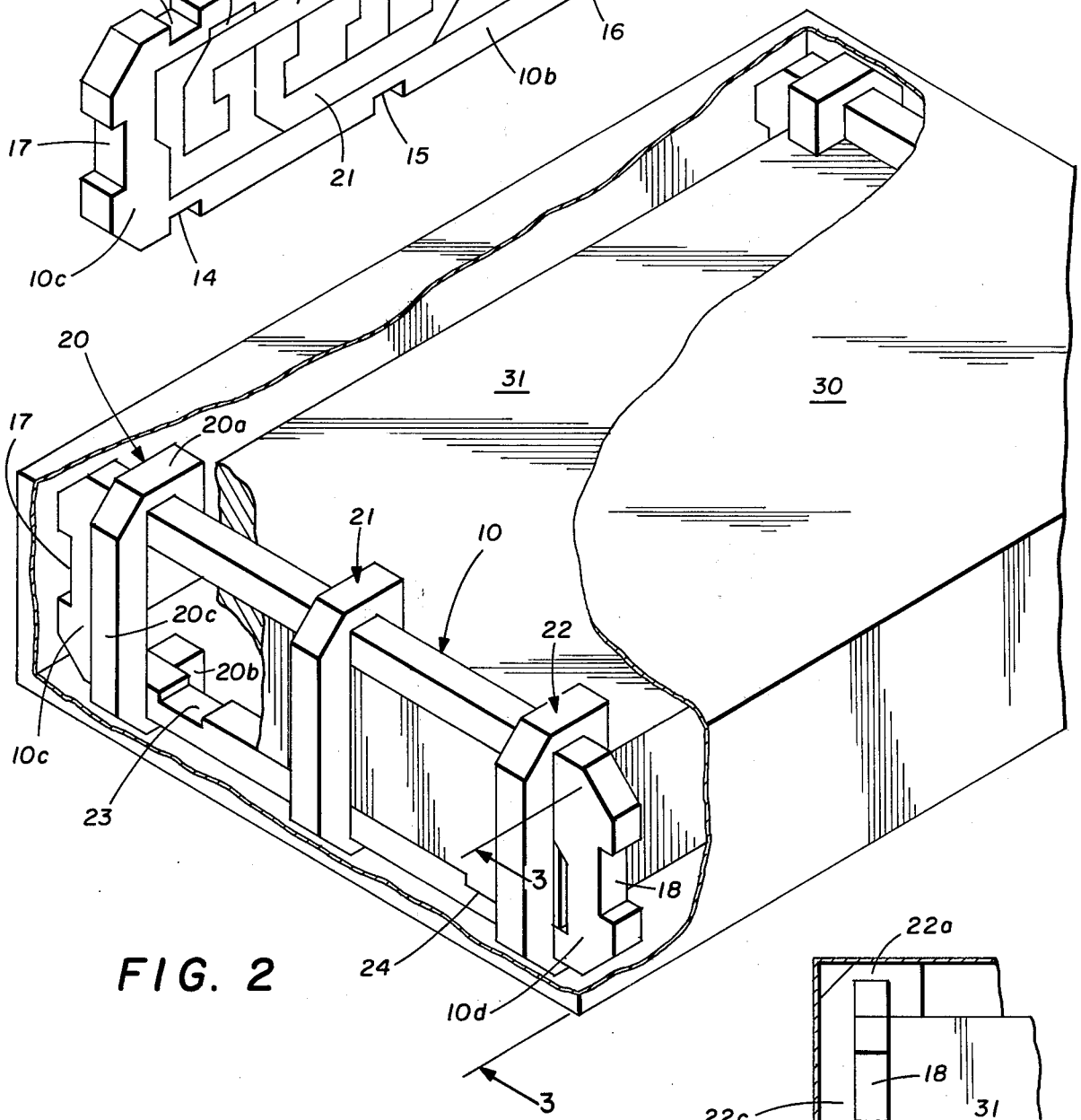
FIG. 2
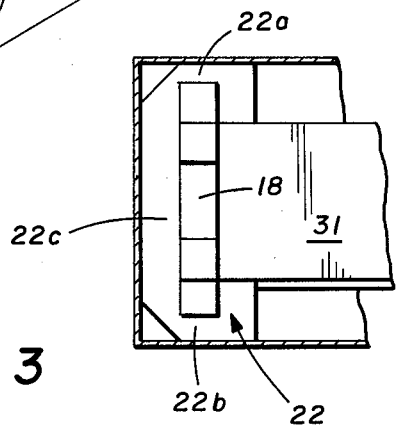
FIG. 3

INTERFITTING SHIPPING PAD

FIELD OF THE INVENTION

The invention relates to shipping pads used in containers to protect articles of manufacture from damage, and more particularly to a shipping pad wherein the component parts are formed from a single sheet of shipping pad material.

PRIOR ART

Transport containers used in the packaging of products heretofore have included materials such as felts, wood-wool, rubber and even metal springs to protect against mechanical shock and compression. More recently, low cost materials such as expanded or foamed plastic has been used to fabricate shock isolating packaging means for the protection of goods.

U.S. Pat. No. 3,003,656 to Hardigg discloses the manufacture of shock isolator elements from a foam block. U.S. Pat. No. 3,166,227 to Ragnow discloses the use of corner pads of foam material which may be produced in a flat form to facilitate storage, and which may be readily assembled as required. Further, U.S. Pat. No. 3,334,798 to Pezely, Jr., et al., describes packaging modules of impact absorbing material having interlocking tongue and groove portions. Such packaging modules are placed about the side, edge and corner of an article. U.S. Pat. No. 3,564,811 to Freeman is directed to the manufacture of U-shaped or apertured sections from a rectangular foam block. U.S. Pat. No. 3,565,243 to Freeman discloses a cushioning member comprised of a plurality of U-shaped or apertured sections of foam plastic which are hinged together.

Where integrated shipping pads have not been used, increased amounts of packaging material has been required to protect a product. Further, the manufacturer of integral shipping pad frames or modular component parts for later assembly has resulted in unnecessary waste of the materials from which the pads are formed. In addition, those pads having modular components have generally required an adhesive or other external fastening means for assembly.

The present invention is directed to an interfitting pad which is formed from modular component parts cut from a single sheet of foam material to facilitate storage and minimize water. Further, the component parts may be interlocked without the use of adhesives or other external fastening means.

SUMMARY OF THE INVENTION

An interfitting shipping pad of plastic foam material is provided which has three dimensional shock resistant characteristics for protecting an article of manufacture from damage. The pad is fabricated from a single sheet of foam material. More particularly, a frame having an inner perimeter complementing the external shape of a product is cut from the foam sheet. C-shaped cross members are cut from the left over material to form cross members of the shipping pad. Each cross member overlaps and fits within transverse grooves formed in the top and bottom edges of the frame. The cross members and frme thereby may coact to form a shock resistant shipping pad without the use of adhesives or other external fastening means.

DESCRIPTION OF THE DRAWINGS

For a more complete understanding of the present invention and for further objects and advantages thereof, reference may now be had to the following description taken in conjunction with the accompanying drawings in which:

FIG. 1 is an isometric view of an embodiment of the invention before assembly;

FIG. 2 is an isometric view of a container partially cut away to expose the invention of FIG. 1 in assembled form and employed for protection of a packaged product;

FIG. 3 is a cross-sectional view of the container and an end view of the invention taken along lines 3–3 of FIG. 2.

DESCRIPTION OF THE PREFERRED EMBODIMENTS

Figure 4:
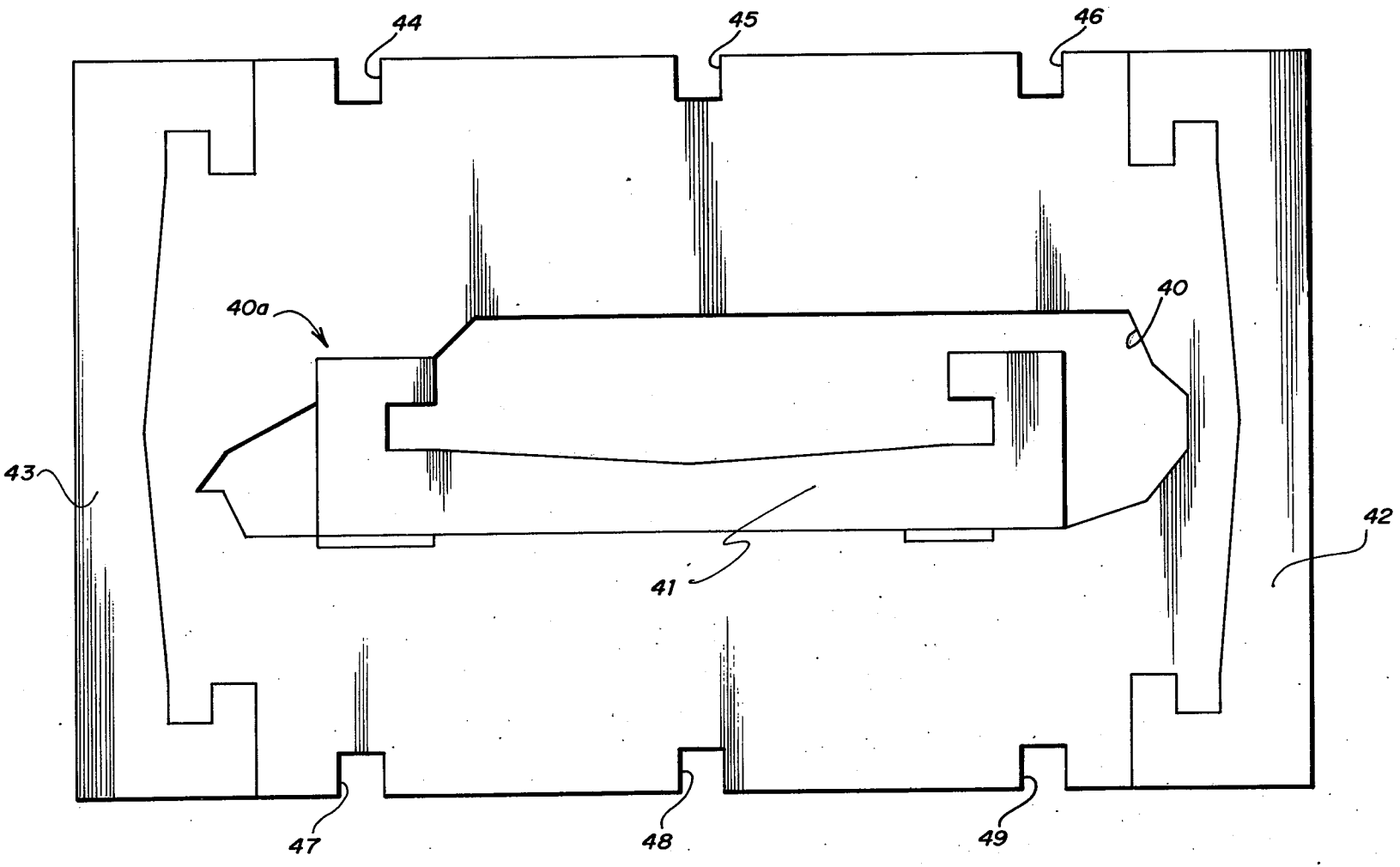
FIG. 4 is a plan view of a second embodiment of the invention in disassembled form to facilitate storage.

FIG. 1 illustrates a shipping pad in accordance with the present invention which is in a disassembled form to facilitate storage.

A frame 10 is cut from a single sheet of plastic form material. Transverse grooves 11–13 are cut into the upper edge of a horizontal member **10*a* of the frame, and transverse grooves 14–16 are cut into the lower edge of a horizontal member 10*b* in alignment with grooves 11–13, respectively. Further, transverse grooves 23 and 24 are cut into the lower edge of member 10*b*. In addition, transverse grooves 17 and 18 are cut into opposite ends 10*c* and 10*d*** of the frame and the corners of each of the ends are beveled.

The interior perimeter 19 of the frame 10 is shaped to generally conform with the exterior of the product to be packaged. C-shaped cross members 20–22 are fabricated from the material cut away from the interior of the frame 10. That part of the cut away material to be discarded thereby is minimized.

FIG. 2 illustrates a shipping pad in final assembled form and placed within a container 30 about a packaged product 31. Cross member 20 has been fitted into grooves 11 and 14 with U-shaped member portions **20*a* and 20*b* overlapping the grooves to form an interlock. The vertical portion 20*c* of the cross member is faced opposite to the end of product 31 to form an impact buffer. Further, member portions 20*a* and 20*b* are in contact with the top and bottom intersurfaces of container 30 to further protect the product 31. To complete the assembly, the cross member 21 is seated within grooves 12 and 15, and the cross member 22 is seated within grooves 13 and 16**.

With the shipping pad in fully assembled form and the product 31 seated within perimeter 19 as shown in FIG. 2, the frame 10 and cross members 20–22 coact to protect the product from impacts to the top, bottom and end of container 30. Further, the end portions **10*c* and 10*d* of frame 10 are in contact with the sides of container 30, and act to protect the product 31** from side blows.

FIG. 3 is a cross sectional view of the container 30 exposing the end of the assembled shipping pad. Container 31 has been positioned within the inner perimeter 19 of the frame 10. A U-shaped member portion **22*a* of cross member 22 overlaps the frame 10 to abut the upper surface of the product 31. Further, a U-shaped member portion 22*b* overlaps the frame 10 to abut the lower surface of the product 31. Impacts to the top and bottom of the container 30 thereby are resisted by the cross member 22 to protect the product 31**.

The vertical portion 22*c* of cross member 22 traverses the frame 10 and is in contact with the inner end surface of container 30. Impacts to the end of container 30 thus may be absorbed by the vertical portion 22*c*.

The ends 10*c* and 10*d* of frame 10 rest against the inner side surfaces of container 30. Blows or impacts to the sides of container 30 thus are absorbed along the length of frame 10.

FIG. 4 illustrates a plastic foam sheet after it has been stamped or cut in accordance with packaging requirements. The modular component parts of the shipping pad may be left in place to facilitate storage. When the shipping pad is to be assembled, the modular components may be removed from the foam sheet, and the remaining material may be discarded.

In the fabrication of a shipping pad, the perimeter 40 of a product, such as for example a chassis for an electronic module, is cut into the foam sheet. The material within the perimeter outline also may be utilized. With slight interference to the chassis perimeter as indicated at 40*a*, an interlocking cross member 41 may be fabricated. Thus, waste of the foam material is substantially minimized. Two additional interlocking cross members 42 and 43 also may be formed from the foam sheet. Further, transverse grooves 44–49 are cut into the upper and lower edges of the sheet to receive the cross members as before described.

A shipping pad system has been described, all of the modular component parts of which may be fabricated from a single plastic foam sheet. The component parts need not be removed from the foam sheet until needed to facilitate storage. When a shipping pad is to be assembled, however, the component parts are detached from the foam sheet and assembled with minimal waste. No adhesives or other fastening means foreign to the foam sheet need be used.

Having described the invention in connection with certain specific embodiments thereof, it is to be understood that further modifications may now suggest themselves to those skilled in the art, and it is intended to cover such modifications as fall within the scope of the appended claims.

I claim:

1. A shock resistant shipping pad for packing an article in a transport container comprising:

a frame having parallel top and bottom members integrally joined to perpendicularly disposed first and second end members to define an aperture complementing an outer surface of the article;

said frame top member having a plurality of transverse grooves disposed at spaced points along a top surface of said frame top member;

said frame bottom member having a plurality of transverse grooves disposed at spaced points along a bottom surface of said frame bottom member opposite said transverse grooves of said frame top member; and a plurality of cross members for providing lateral shock resistance to the article, each cross member having upper and lower ends and transversing said aperture defined by said frame members, such that said cross member upper ends of said plurality of cross members engage and interlock with said frame top member transverse apertures and said lower ends of said plurality of cross members engage and interlock with a corresponding frame bottom member transverse aperture to permit the outer surface of the article to contact said frame members and said plurality of cross members to provide three dimensional shock resistance to the article within the transport container.

2. The combination of claim 1 wherein said plurality of cross members overlap said frame top and bottom members to abut upper and lower surfaces of the article.

3. The combination of claim 2 wherein each of said plurality of cross members are C-shaped in structure.

* * * * *

UNITED STATES PATENT AND TRADEMARK OFFICE

CERTIFICATE OF CORRECTION

PATENT NO. : 4,122,946

DATED : October 31, 1978

INVENTOR(S) : Ronnie E. Holley

It is certified that error appears in the above-identified patent and that said Letters Patent are hereby corrected as shown below:

Column 1, line 49, change "water" to --waste--.

Column 1, line 66, change "frme" to --frame--.

Signed and Sealed this

*First* Day of *May 1979*

[SEAL]

*Attest:*

RUTH C. MASON
*Attesting Officer*

DONALD W. BANNER
*Commissioner of Patents and Trademarks*